United States Patent [19]

Alexander et al.

[11] 4,248,114

[45] Feb. 3, 1981

[54] CUTTER OF ELONGATED MATERIAL

[75] Inventors: David C. Alexander; Vance R. Meek, both of Salisbury, N.C.

[73] Assignee: Fiber Industries, Inc., New York, N.Y.

[21] Appl. No.: 15,975

[22] Filed: Feb. 28, 1979

[51] Int. Cl.[3] ..... D01G 1/04

[52] U.S. Cl. ..... 83/347; 83/348; 83/698; 83/913

[58] Field of Search ..... 83/37, 346, 347, 663, 83/674, 913, 348, 698

[56] References Cited

U.S. PATENT DOCUMENTS

| | | | |
|---|---|---|---|
| 2,010,078 | 8/1935 | Hale | 83/913 X |
| 2,096,080 | 10/1937 | Berne-Allen, Jr. | 83/913 X |
| 2,167,916 | 8/1939 | Taylor et al. | 83/913 X |
| 2,221,022 | 11/1940 | Ellis | 83/913 X |
| 2,258,661 | 10/1941 | Pool . | |
| 2,570,446 | 10/1951 | Hoffman . | |
| 2,745,491 | 5/1956 | Sonneborn et al. | 83/913 X |
| 2,792,887 | 5/1957 | Middelhof | 83/913 X |
| 2,851,103 | 9/1958 | Anthony et al. | 83/913 X |
| 3,062,082 | 11/1962 | Keith | 83/913 X |
| 3,104,580 | 9/1963 | Moody et al. | 83/913 X |
| 3,198,049 | 8/1965 | Chaussy et al. | 83/913 X |
| 3,485,120 | 12/1969 | Keith | 83/913 X |
| 3,508,461 | 4/1970 | Stream | 83/913 X |
| 3,557,648 | 1/1971 | Coffin | 83/913 X |
| 3,644,109 | 2/1972 | Klink et al. | 83/913 X |
| 3,744,361 | 7/1973 | Van Doorn | 83/913 X |
| 3,777,610 | 12/1973 | Spaller, Jr. | 83/913 X |
| 3,796,119 | 3/1974 | Fox | 83/913 X |
| 3,826,163 | 7/1974 | Spaller, Jr. | 83/913 X |
| 3,831,481 | 8/1974 | Van Doorn | 83/913 X |
| 3,834,263 | 9/1974 | Smith | 83/913 X |
| 3,861,257 | 1/1975 | Laird | 83/913 X |
| 3,869,268 | 3/1975 | Briar | 83/913 X |
| 3,915,042 | 10/1975 | Laird | 83/913 X |
| 4,014,231 | 3/1977 | Hutzezon | 83/913 X |
| 4,063,479 | 12/1977 | Roncato | 83/913 X |
| 4,083,279 | 4/1978 | Wester | 83/913 X |
| 4,120,222 | 10/1978 | Potter | 83/913 X |
| 4,141,115 | 2/1979 | Fourne et al. | 83/913 X |

*Primary Examiner*—J. M. Meister

*Attorney, Agent, or Firm*—Thomas J. Morgan; Charles B. Barris; Roderick B. Macleod

[57] ABSTRACT

An improved apparatus for cutting material such as filamentary tows into predetermined lengths comprising (a) a cutting assembly including a plurality of spaced apart knife edges secured to a mounting member at equal radial distances from a point on said mounting member thereby forming a reel, each of said radial distances in every instance being less than the distance from said point to the periphery of said mounting member; (b) said cutting assembly having means adapted to receive successive wrappings of material to be cut in contact with a plurality of said knife edges so that no relative movement occurs between said material and said knife edges longitudinally of said material; and (c) means for forcing said material between adjacent knife edges thereby severing said material into lengths of controlled dimensions, wherein the improvement comprises: means for preventing at least most of said knives from moving in a direction longitudinal of said knife edges.

6 Claims, 13 Drawing Figures

FIG 7
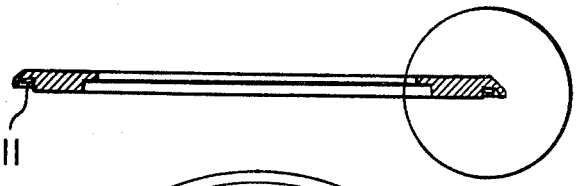
FIG. 9
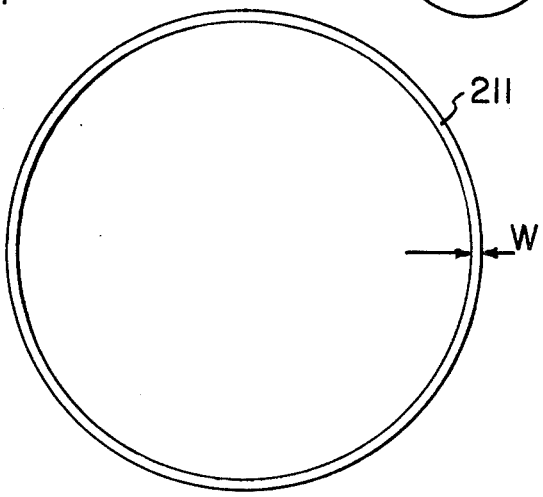
FIG. 10
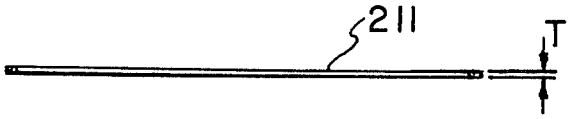
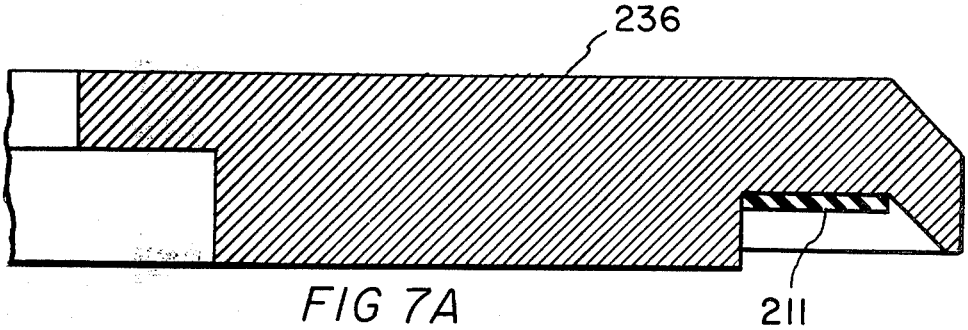
FIG 7A
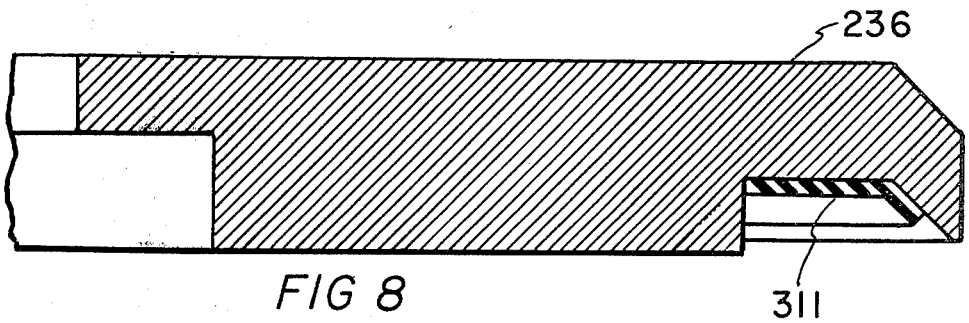
FIG 8

CUTTER OF ELONGATED MATERIAL

BACKGROUND OF THE INVENTION (i) Field of the Invention

The invention relates broadly to an improved apparatus and process for cutting elongated material, such as filamentary tows, into predetermined lengths, such as staple fiber. More particularly, it relates to an improvement to the means for holding the plurality of knife edges.

(ii) Prior Art

FIGS. 1–4 (Prior Art) of this application are essentially identical to FIGS. 1–4 of U.S. Pat. No. 3,485,120 (Keith), "Method and Apparatus for Cutting Elongated Material". With reference to these Figures, U.S. Pat. No. 3,485,120 discloses an apparatus for cutting material such as filamentary tows (64) into predetermined lengths comprising (a) a cutting assembly (18) including a plurality of spaced apart knife (28) edges (30) secured to a mounting member (22) at equal radial distances from a point on said mounting member (22) thereby forming a reel (18), each of said radial distances in every instance being less than the distance from said point to the periphery of said mounting member (22); (b) said cutting assembly (18) having means adapted to receive successive wrappings of material to be cut (64) in contact with a plurality of said knife (28) edges (30) so that no relative movement occurs between said material and said knife (28) edges (30) longitudinally of said material; and (c) means for forcing said material between adjacent knife (28) edges (30) [presser roll (42)], thereby severing said material into lengths of controlled dimensions. A more detailed description will be found in U.S. Pat. No. 3,485,120, particularly columns 3 and 4.

FIG. 3 (Prior Art) shows a gap between the top of the knives (28) and the bottom of the annular cap (36) which "protects" the upper end of blades (28).

U.S. Pat. No. 3,733,945 is a patent of improvement relative to forementioned U.S. Pat. No. 3,485,120, and is particularly directed to the use of a stream of air to remove cut fibers from the apparatus.

In addition, there has been public use for more than one year of the cutter reel shown in FIG. 11 (Prior Art). In the sandwich construction the knife (400) is bevelled at the top and the upper ring (236) is bevelled at the bottom. Accordingly, the upper ring prevents some (probably 3) of the knives from moving in a direction longitudinal of the knife edges. However, most of the knives are free to move at least a small amount in a direction longitudinal of the knife edges, on account of variations in length of the knives and other tolerances causing both Gap A and Gap B in FIG. 11 to be greater than zero.

None of the foregoing prior art has means for preventing all movement of at least most of the knives in an upwards direction longitudinal of the knife edges.

SUMMARY OF THE INVENTION

In contrast to the forementioned prior art, it has been discovered that it is highly advantageous to modify such apparatus by incorporating means for preventing at least most, and preferably all, of the knives from moving in a direction longitudinal of the knife edges, even by a small amount.

The invention arose out of the discovery that the cutting performance of prior art apparatus significantly deteriorated over a prolonged period of time even after the apparatus had been equipped with new sharp knives. In particular, firstly, the number of "long fibers" increased. A "long fiber" is defined as any filament having a length greater than the distance between successive adjacent knife edges. Long fibers cause problems during subsequent processing, such as carding. In addition, secondly, there was a tendency for clumps of cut fiber to become permanently trapped adjacent the knives at points remote from the middle of the edges of the knives. In order to determine the cause of this maloperation, a detailed examination was made of the component parts of the reel or cutting assembly. The type of wear found there indicated that upward forces imposed on the knives during the cutting operation were sufficient to overcome gravity, thereby causing the knives to "chatter" in a vertical direction.

As an experiment, resilient gasket means for preventing the knives from moving in a direction longitudinal of their edges was installed in pre-existing worn apparatus. This apparently resulted in an improvement in cutting performance.

Similarly, resilient gasket means was then installed in apparatus without worn parts. The gasket was found to have a life many times the life of the knives and greatly reduced the amount of wear taking place in the much more expensive components of the pre-existing cutting assembly.

BRIEF DESCRIPTION OF THE DRAWINGS

FIG. 1 is a side elevation view of the cutting apparatus according to the Keith apparatus illustrating the relationship between the various elements thereof and showing a preferred cutting reel configuration.

FIG. 2 is a view taken along line 2—2 of FIG. 1 and showing in the specification relationship between the cutting reel the pressure applicator, and the material being severed.

FIG. 3 is an enlarged detailed, fragmentary view taken along line 3—3 of FIG. 2 showing the manner in which the knife blades are secured in the cutting reel according to one embodiment of the Keith apparatus.

FIG. 4 is an enlarged, fragmentary, detail view showing the relationship between the blades, the material being severed and the pressure applicator at the point of cutting.

FIG. 7 is a fragmentary side elevation of one embodiment of the upper part of the knife holding means of this invention.

FIG. 7A is an enlarged view of part of FIG. 7.

FIG. 8 is an enlarged fragmentary side elevation of another embodiment of the upper part of the knife holding means of this invention.

FIG. 9 is a plan view of gasket 211 of FIG. 7.

FIG. 10 is an elevation of FIG. 9.

DESCRIPTION OF THE PREFERRED EMBODIMENTS

In its broadest aspect, the apparatus of the invention is an improved apparatus for cutting material such as filamentary tows into predetermined lengths comprising (a) a cutting assembly including a plurality of spaced apart knife edges secured to a mounting member at equal radial distances from a point on said mounting member thereby forming a reel, each of said radial distances in every instance being less than the distance from said point to the periphery of said mounting member; (b) said cutting assembly having means adapted to receive successive wrappings of material to be cut in contact with a plurality of said knife edges so that no relative movement occurs between said material and said knife edges longitudinally of said material; and (c) means for forcing said material between adjacent knife edges thereby severing said material into lengths of controlled dimensions, wherein the improvement comprises means for preventing at least most of said knives (28 or 400) from moving in a direction longitudinal of said knife edges.

The process of the invention, in its broadest aspect, is an improved method for cutting elongated material into a number of shorter lengths, comprising the steps of (a) continuously feeding the elongated material to a plurality of knife edges and extending the inner layer of the material across and in contact with each two adjacent knife edges of the plurality of knife edges so that the inner layer is in lightly tensioned touch contact with the knife edges; and (b) applying a pressure against the material that is outwardly of the inner layer thereby forcing said inner layer against said knife edges and while retaining the inner layer in extended manner across said adjacent knife edges cutting said inner layer into said number of shorter lengths, wherein the improvement comprises rigidly holding said knives, thereby reducing chatter of said knives.

Figure 1:
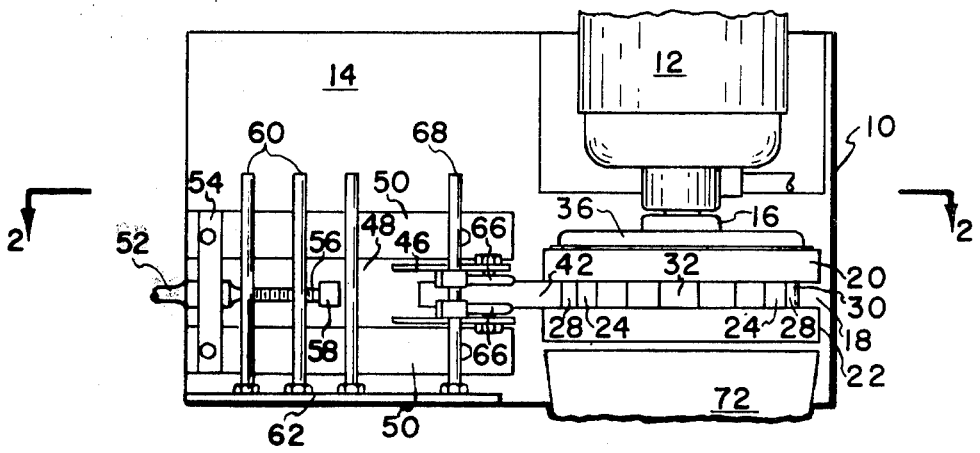
FIG. 1 (PRIOR ART)
FIG. 1–4 represent prior art discussed above.
Figure 2:
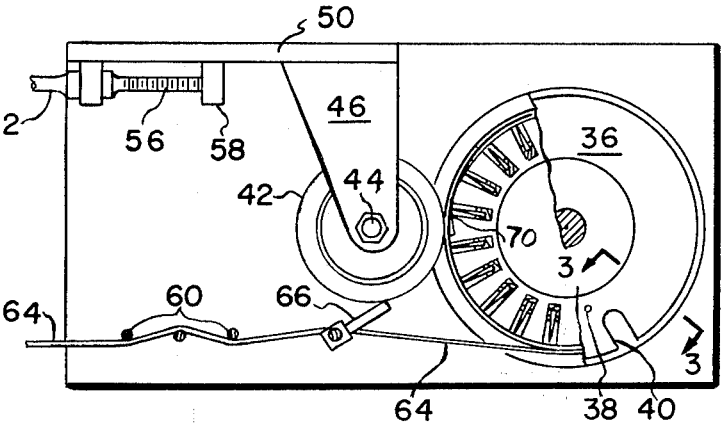
FIG. 2 (PRIOR ART)
Figure 3:
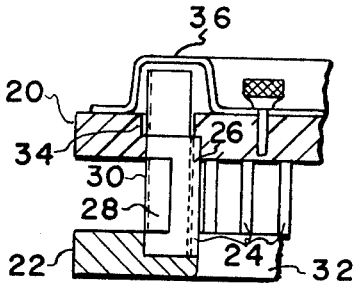
FIG. 3 (PRIOR ART)
Figure 4:
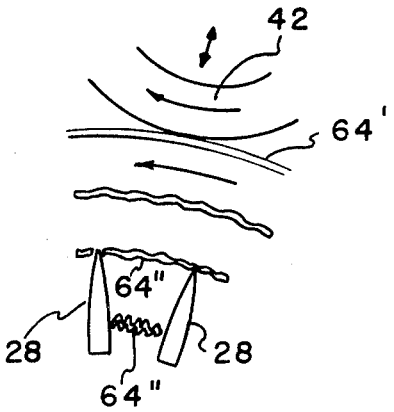
FIG. 4 (PRIOR ART)
Figure 5:
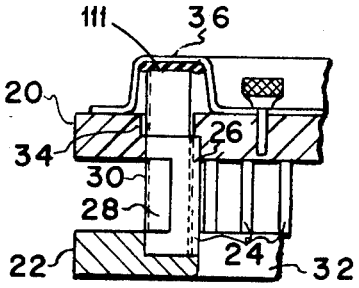
FIG. 5 shows in side elevation one embodiment of this invention. In particular, gasket (111) differentiates FIG. 5 from FIG. 3.
Figure 6:
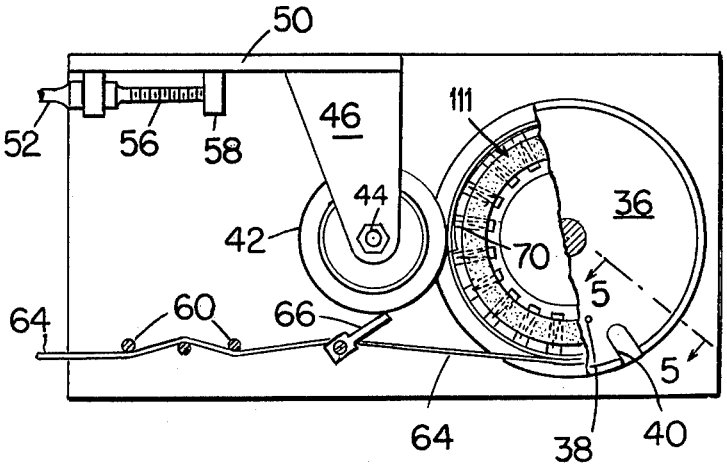
FIG. 6 shows the same embodiment of this invention as FIG. 5 in plain view.
Figure 11:
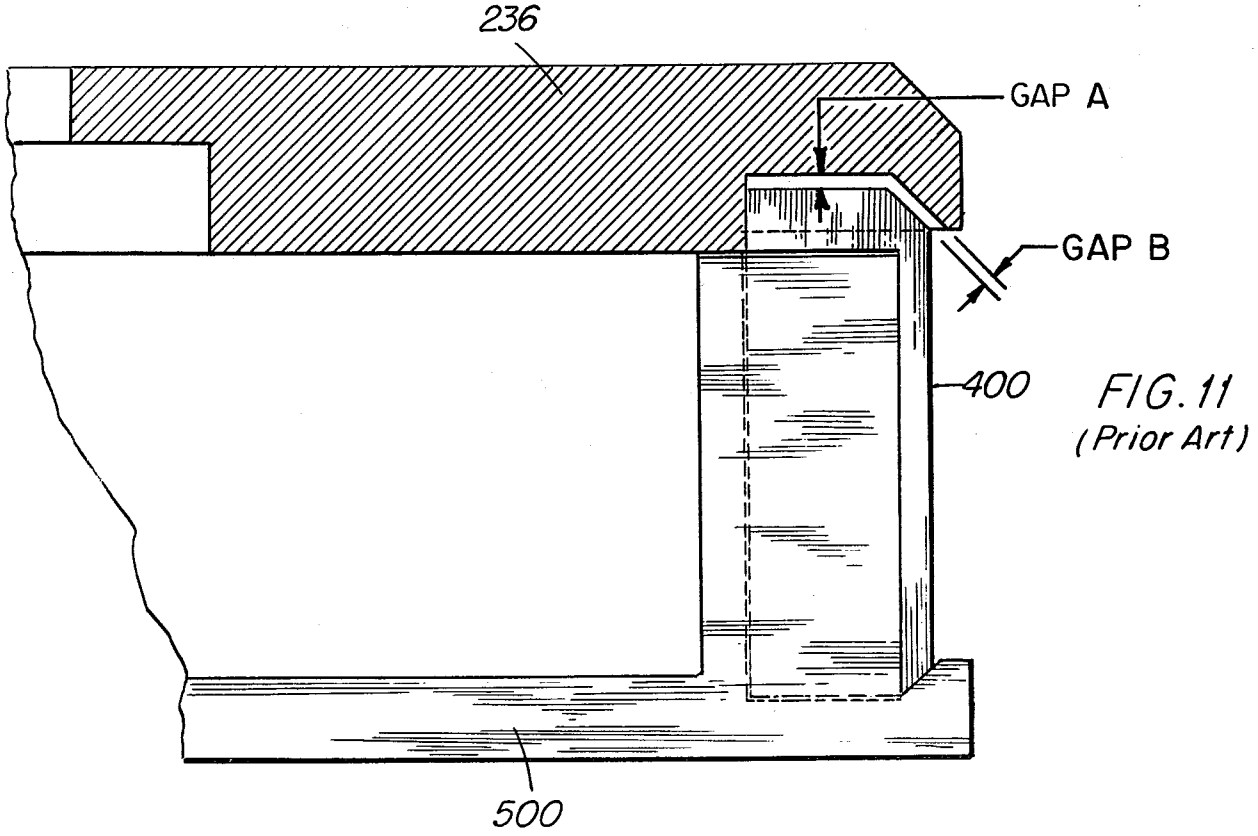
FIG. 11 (Prior Art)
FIG. 11 is an enlarged fragmentary view of prior art discussed above.
Figure 12:
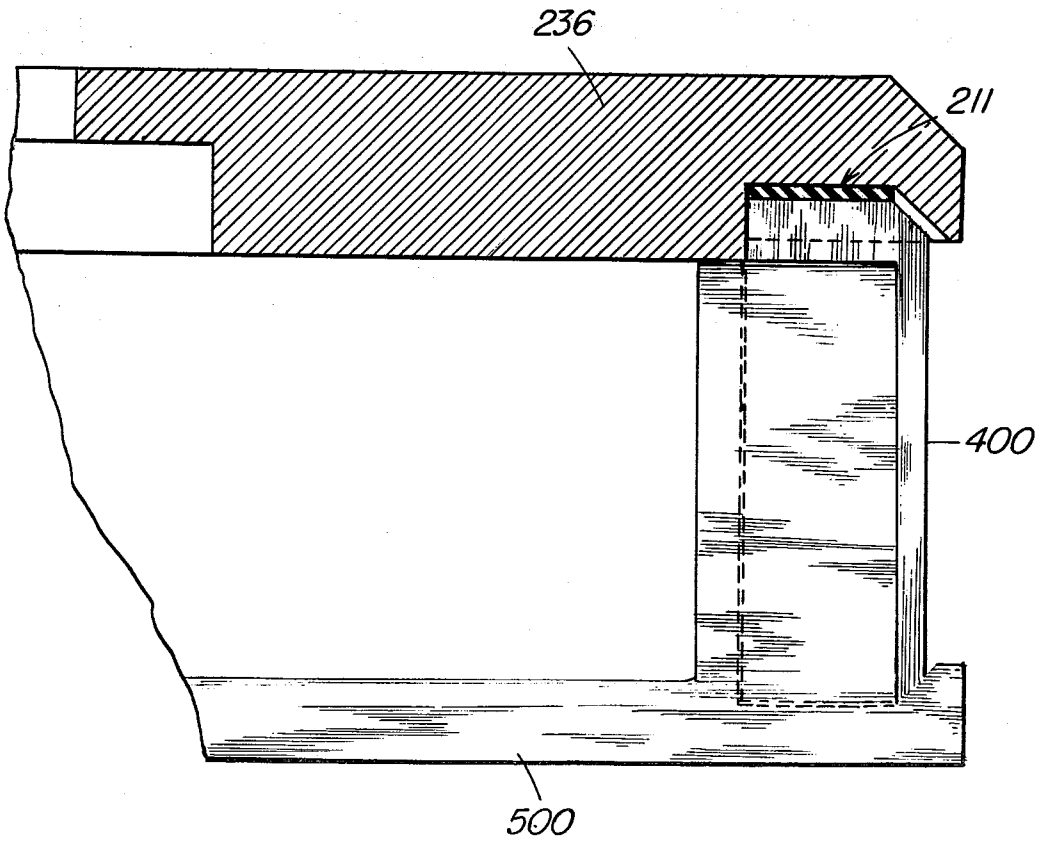
FIG. 12 is a fragmentary side elevation of another embodiment of this invention.

FIGS. 5, 6, 7, 7A, 8, 9, 10 and 12 illustrate various embodiments of the invention. The heart of the invention is gasket 111 in FIG. 5; gasket 211 in FIGS. 6, 7, 7A, 9, 10 and 12; and gasket 311 in FIG. 8. Clamping means for holding the sandwich assembly together is omitted from these figures for simplicity. Any conventional, preferably quickly operable, clamping means is appropriate.

As shown in the drawings, it is preferred that the "prevention means" comprise an annular ring of pressure loaded resilient material with the resilient material being pressed against at least one end (most preferably the upper end) of each said knife.

It is further preferred that the resilient material is in the form of a flat gasket having a thickness, T (see FIG. 10) in the range of 1/32 inch to ¼ inch and a hardness, measured by Shore A durometer, in the range of 20 to 60.

It is also preferred that the "prevention means" be applied to all the knives in the cutting assembly.

It appears that the gasket provides a cushion between the blades and retainer and makes possible a secure fit which is otherwise difficult to obtain with metal-to-metal contact, due to manufacturing tolerances in the blades and other improvements of the cutting reel.

The invention reduces wear to the blade retainer and reel which would ordinarily result from blade movement or vibration. Use of the invention permits a significant cost savings due to the reduced wear on the retainer and cutter reel, with possible improvement in stable quality.

Numerous other variants of the invention, such as alternate cross-sections will be apparent to one skilled in the art, but are not described in detail in this specification.

What we claim is:

1. An improved apparatus for cutting material such as filamentary tows into predetermined lengths comprising (a) a cutting assembly including a plurality of spaced apart knife edges secured to a mounting member at equal radial distances from a point on said mounting member thereby forming a reel, each of said radial distances in every instance being less than the distance from said point to the periphery of said mounting member; (b) said cutting assembly having means adapted to receive successive wrappings of material to be cut in contact with a plurality of said knife edges, so that no relative movement occurs between said material and said knife edges longitudinally of said material; and (c) means for forcing said material between adjacent knife edges, thereby severing said material into lengths of controlled dimensions, wherein the improvement comprises:

means for preventing all of said knives from moving in a direction longitudinal of said knife edges; wherein said prevention means comprises an annular ring of pressure loaded resilient material, said resilient material being pressed against at least one end of each said knife; wherein said resilient material is in the form of a flat gasket having thickness, T, in the range of 1/32 inch to ¼ inch and a hardness, measured by Shore A durometer, in the range of 20 to 60; and wherein said gasket has a life many times the life of said knives.

2. The apparatus of claim 1 which comprises only one gasket.

3. The apparatus of claim 1, wherein said gasket is reusable.

4. The apparatus of claim 2, wherein said gasket is pressed against said knives' upper ends.

5. The apparatus of claim 1 which comprises apparatus for cutting filamentary tows into predetermined lengths suitable for carding.

6. The apparatus of claim 5 which comprises only one gasket; said gasket being reusable and pressed against said knives' upper ends.

* * * * *